United States Patent [19]

Watterson

[11] Patent Number: 4,813,667

[45] Date of Patent: Mar. 21, 1989

[54] MULTIPURPOSE EXERCISER

[75] Inventor: Scott R. Watterson, River Heights, Utah

[73] Assignee: Weslo, Inc., Logan, Utah

[21] Appl. No.: 9,387

[22] Filed: Jan. 30, 1987

Related U.S. Application Data

[63] Continuation-in-part of Ser. No. 861,050, May 8, 1986.

[51] Int. Cl.[4] ..... A63B 69/18; A63B 69/06

[52] U.S. Cl. ..... 272/97; 272/70; 272/72; 272/132; 272/134; 272/130; 272/DIG. 4

[58] Field of Search ..... 272/134, 72, 70, 97, 272/144, DIG. 4, 130, 133, 125

[56] References Cited

U.S. PATENT DOCUMENTS

| | | | |
|---|---|---|---|
| 2,772,881 | 12/1956 | Fundom | 272/70 |
| 3,589,720 | 6/1971 | Agamian | 272/126 |
| 3,770,267 | 11/1973 | McCarthy | 272/72 X |
| 3,792,860 | 2/1974 | Seines | 272/126 |
| 3,892,404 | 7/1975 | Martucci | 272/134 |
| 4,023,795 | 5/1977 | Pauls | 272/97 |
| 4,284,272 | 8/1981 | Evans et al. | 272/72 |
| 4,316,609 | 2/1982 | Silberman | 272/118 |
| 4,402,506 | 10/1982 | Jones | 272/DIG. 4 X |
| 4,477,071 | 10/1984 | Brown et al. | 272/72 |
| 4,529,194 | 7/1985 | Haaheim | 272/69 |
| 4,533,136 | 8/1985 | Smith et al. | 272/73 |
| 4,541,627 | 9/1985 | McLean | 272/72 |
| 4,572,500 | 2/1986 | Weiss | 272/72 |
| 4,618,139 | 10/1986 | Haaheim | 272/70 |
| 4,623,144 | 11/1986 | Rockwell | 272/134 |
| 4,659,077 | 4/1987 | Stropkay | 272/97 |
| 4,684,121 | 8/1987 | Nestegard | 272/72 X |
| 4,709,918 | 12/1987 | Grinblat | 272/134 X |

FOREIGN PATENT DOCUMENTS

| | | |
|---|---|---|
| 5110842 | 3/1976 | Japan . |
| 356467 | 9/1931 | United Kingdom . |

OTHER PUBLICATIONS

Article from Nov. 1986 Consumer Reports entitled "Cross-Country Ski Exercisers" pp. 747-749.

*Primary Examiner*—Richard J. Apley
*Assistant Examiner*—Howard Flaxman
*Attorney, Agent, or Firm*—Trask, Britt & Rossa

[57] ABSTRACT

A multipurpose exercise apparatus may be assembled into a plurality of configurations and positioned in a plurality of orientations to perform a variety of exercises, including cross-country-skiing-type exercises and rowing-type exercises. The apparatus includes a main frame having said support adapted thereto for supporting the frame on an exercise surface. A track is mounted on the main frame. A pair of foot pedals is slidably mounted on the track means. A reciprocation structure is mechanically associated with the foot pedals for effecting a reciprocative movement of each foot pedal, one relative to the other. At least one pair of movable lever members is mounted on the main frame for movement by the apparatus' user. A foot support is mounted to the main frame for bracing the user's feet when performing various-type exercises.

27 Claims, 3 Drawing Sheets

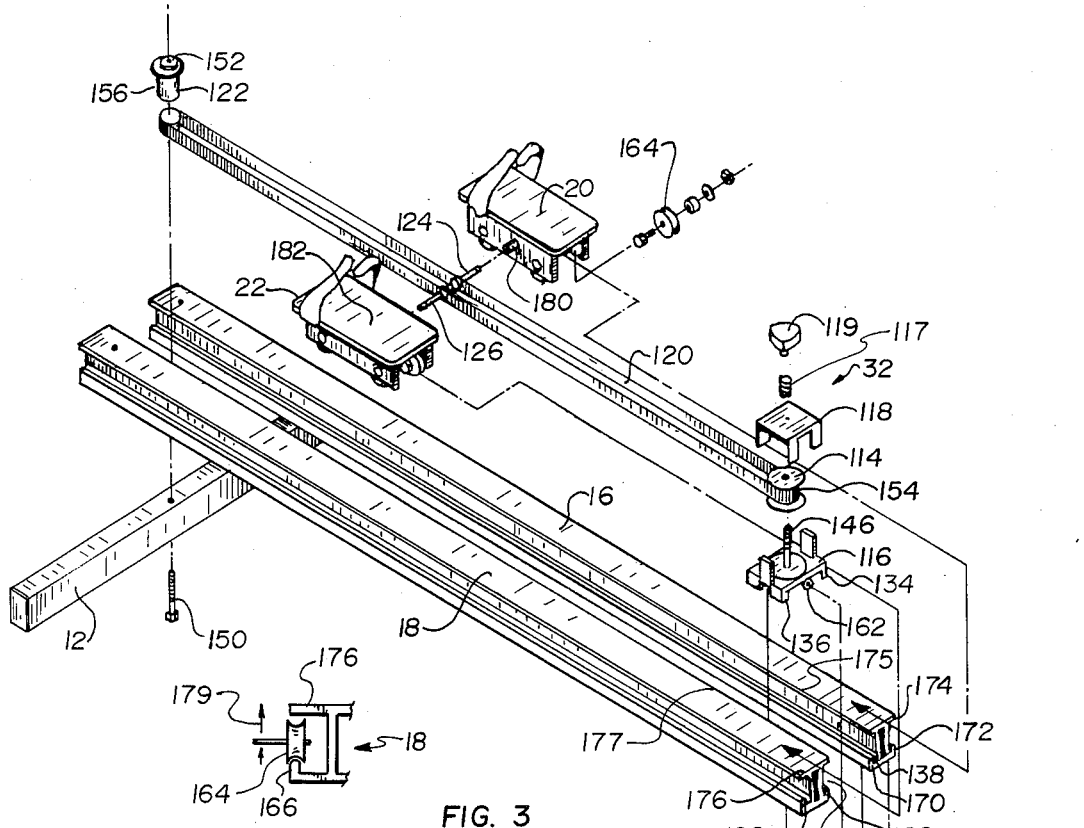
FIG. 3A
FIG. 3
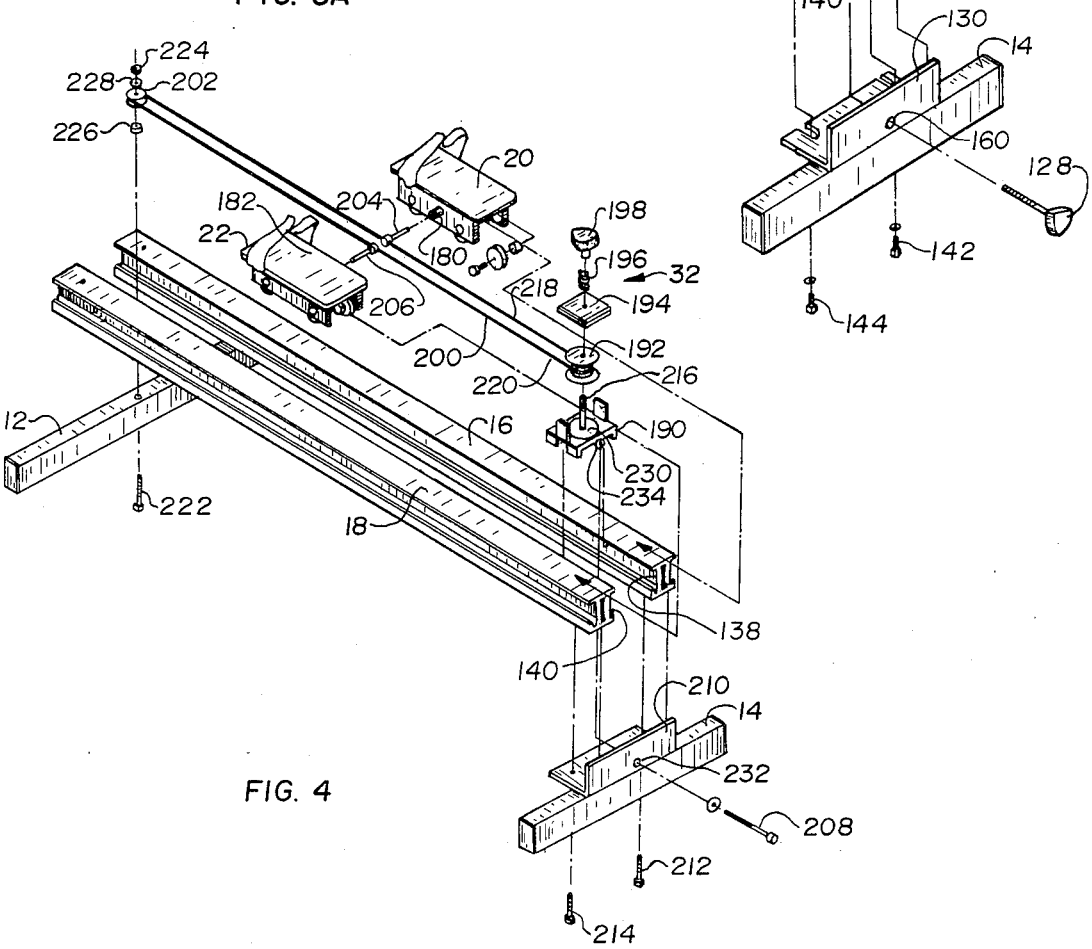
FIG. 4

MULTIPURPOSE EXERCISER

RELATED APPLICATIONS

This application is a continuation-in-part of application Ser. No. 861,050, filed May 8, 1986.

BACKGROUND OF THE INVENTION

1. Field

This invention relates to exercise machines which may be used in several different orientations and configurations to perform a plurality of different exercises, including rowing-type exercises and cross-country-skiing-type exercises.

2. State of the Art

Multipurpose exercise machines which may be reconfigured or reoriented in some manner are known. Some of these machines may be operated, for example, in a horizontal orientation so the user may perform exercises such as rowing exercises, and also in a vertical orientation so the user may perform other exercises such as bench-press exercises. Devices of this type include the Body Tone 300 machine made by Diversified Products Corporation of Opelika, Ala. Devices of this type are also illustrated in U.S. Pat. Nos. 4,477,071 and 4,488,719 (Brown, et al.). Other exercise apparatus upon which a plurality of exercises may be performed are illustrated in U.S. Pat. Nos. 3,586,322 (Kverneland), 3,614,097 (Blickman), U.S. Pat. No. Des. 256,707 (MacLaren-Taylor) and U.S. Pat. No. Des. 263,978 (Brentham). Most of these devices, in at least one configuration, may be used to perform rowing-type exercises.

Even though multipurpose exercise machines are now widely known, no multipurpose exercise machine is known which can be configured or oriented to perform cross-country-skiing-type exercises and other exercises such as rowing exercises.

SUMMARY OF THE INVENTION

A multipurpose exercise apparatus is usable in a plurality of different configurations and orientations for performing different exercises in each orientation or configuration. The apparatus includes a main frame means with support means adapted thereto for supporting the main frame means on an exercise surface. Track means are adapted to the main frame means.

A pair of foot pedals is provided which are slidably adapted to the track means. Reciprocating means are connectable to the pair of foot pedals to cause reciprocating movement of the pedals relative to each other. In other words, as one foot pedal moves in one direction, the other foot pedal must move in the opposite direction. A seat means for supporting a user may be attached by connection means to the foot pedals so that when the reciprocating means is disconnected, the seat means slides with and upon the foot pedals relative to the track means.

The device has two lever means which are preferably interchangeable. The first lever means is preferably comprised of at least one lever, and desirably two elongated levers, which are tubular members pivotally adapted at their distal ends to the main frame means. However, the first lever means is sized and shaped so that a user standing upright upon the foot pedals may comfortably grasp handle grips to perform a back and forth arm motion to simulate planting of ski poles similar to ski pole use in cross-country-skiing.

The second lever means may be utilized as rowing arms when a person is seated upon the seat. The proximal ends are desirably provided with comfortable hand grips to facilitate performance of rowing exercises when the apparatus is in a rowing configuration and orientation. The second lever means is preferably comprised of two tubular members which are also pivotally adapted at their distal ends to the main frame means.

Associated with the first lever means is resistance means which is preferably hydraulic cylinders fitted with a piston to provide surmountable resistance to movement of the lever means. Desirably, the resistance may be adjusted by adjusting the point of attachment of the hydraulic cylinder from a point close to the distal end, that is, the pivoted end, of the lever means, towards a point closer to the proximal end of the lever means.

The first lever means and the second lever means are selectively connectable in place of each other. That is, the first lever means may be adapted to the main frame means in lieu of the second lever means, and vice versa. Thus, with the first lever means in place, the user may stand on the foot pedals and perform cross-country-skiing-type exercises. The apparatus may be reconfigured by selecting and using the second lever means, by connecting the seat means to the foot pedals, and by disconnecting the reciprocating means. Then the user may sit on the seat means and position his feet on foot support means adapted to the main frame means and perform rowing type exercises.

To position the apparatus in a different orientation, second frame means is adapted to the main frame means to support the main frame means in an upright orientation. Preferably, the second frame means includes a first frame member which extends away from one end of the frame means which is desirably the foot end. The first frame member is most preferably an elongated bar or tube member having one end affixed at or near the foot end of the frame and having a free end.

A second frame member is rotatably adapted to said first frame member at the free end of the first frame member. The second frame member may rotate between first position in which it extends from the free end downward toward said track means and a second position in which it extends from the free end away from the apparatus through a third position in which it is in general alignment with the first frame member. A user support means is adaptable to the first frame member and the second frame member. It is desirably structured such that a person using the apparatus may support a portion of his body, such as his back or thoracic region, upon the user support means while performing selected exercises on the apparatus.

With the second frame means adapted, the apparatus may be configured with the second frame member in its first position. The second user support may be adapted thereto to act as a slant board. With the seat means adapted to the foot pedals, the user may reside on the seat means with his back against the second user support to perform various exercises. A chest bar adapted to either the first or second lever means enlarges the type of exercises that may be performed.

With the second frame member in its third position, the apparatus may be reoriented with the main frame means upright. The user may then lie or stand upon the second user support, which is adapted to the first or second frame members, to perform additional exercises. The second frame member may be positioned in the second position for in-use storage and to perform other exercises when the main frame is in a rowing and cross-country-ski-exercise orientation.

BRIEF DESCRIPTION OF THE DRAWINGS

In the drawings, which illustrate what is presently regarded as the best mode for carrying out the invention:

FIG. 3 is an exploded perspective view of resistance and reciprocating structures of the invention;

FIG. 3A is a partial cross sectional view of part of a track of FIG. 3;

FIG. 4 is an exploded perspective view of another embodiment of reciprocating and resistance structures of the invention;

DETAILED DESCRIPTION OF THE ILLUSTRATED EMBODIMENTS

Figure 1:
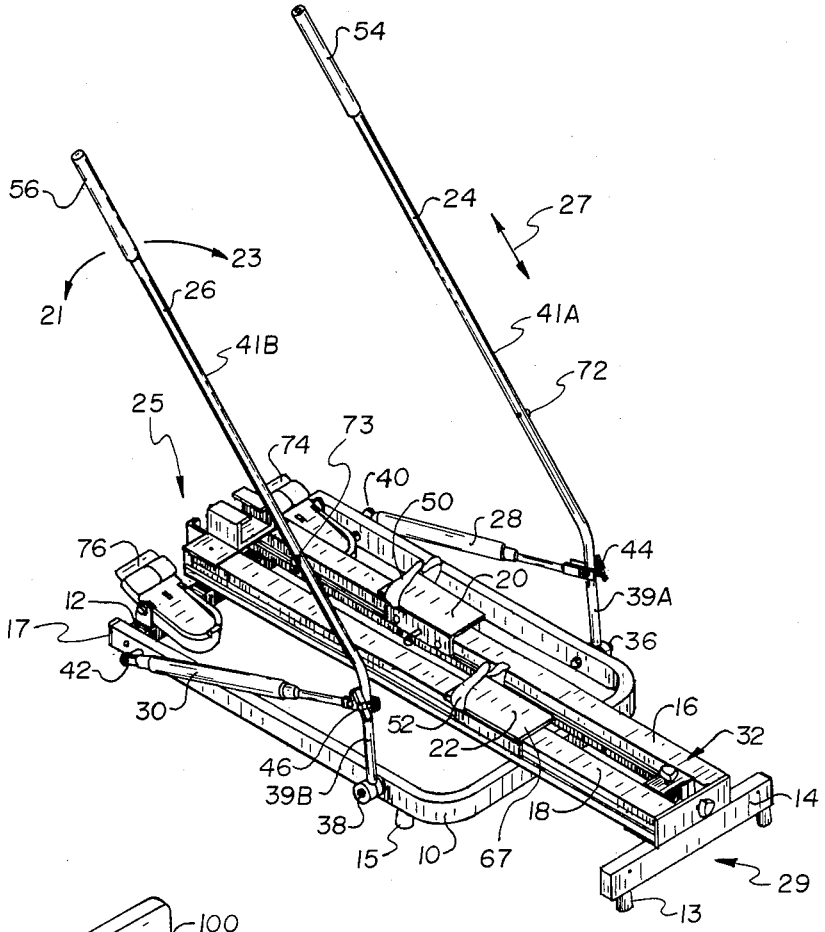
FIG. 1 is a perspective view of a multipurpose exerciser of the invention in a cross-country-skiing exercise configuration.
Figure 2D:
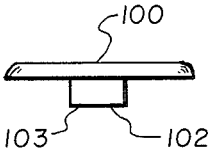
FIG. 2 is a perspective view of a multipurpose exerciser of the invention in rowing configuration.
FIG. 2A is a perspective view of a chest cushion for use with the embodiment of FIG. 2.
FIGS. 2B. and 2D are cross sectional views of user support means of the embodiment of FIG. 2.
FIG. 2C is a partial cross sectional view of components of the embodiment of FIG. 2 at section lines *2c—2c;*
Figure 2B:
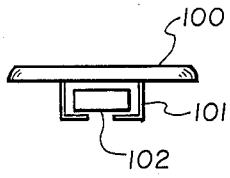
Figure 2:
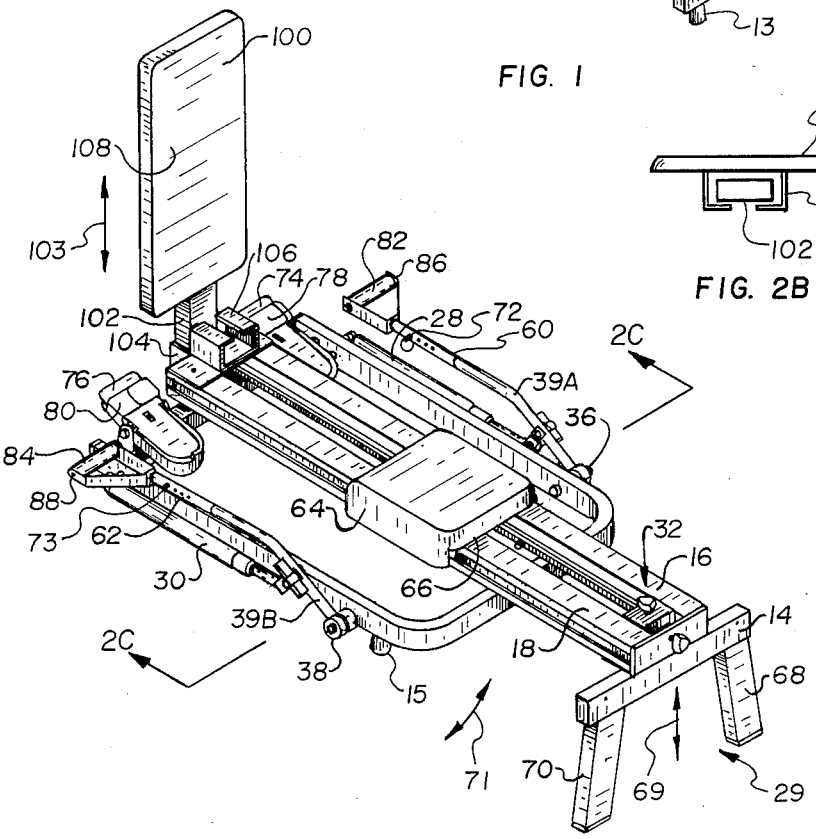

Referring to FIG. 1, a multipurpose exercise apparatus of the invention includes main frame means here shown as a U-shaped frame 10 and a cross piece 12. Support means are adapted to the main frame means to support the main frame on an exercise surface such as a floor. The support means here depicted includes a support member 14 with legs or feet 13 and with additional feet 15 to support the main frame 10 and the apparatus in an orientation as shown which is in general alignment with the exercise surface. It should be noted that the frame may be varied from what may be regarded as a general horizontal alignment by use of feet or supports to elevate one or the other end of the apparatus a preselected height to obtain an optimal grade or slant to the frame 10. The optimal grade or slant may vary from zero degree up to about 30° from the horizontal but, as shown in FIG. 2, is preferably up to about ten degrees (10°) from the horizontal.

The support means may also include rubber-type feet 15 (FIG. 1) and 251 (FIG. 5) positioned on the frame 10 or on the cross piece 12. The support means also includes soft rubber-type inserts 17 fixed on the ends of the frame 10 to support the frame 10 when positioned in an upright orientation, as discussed hereinafter.

The apparatus of FIG. 1 also includes track means which are here shown as a pair of tracks 16 and 18. A pair of pedals 20 and 22 are movably adapted to the tracks 16, 18. First lever means are movably adapted to the frame 10. The first lever means are here shown as a pair of levers 24 and 26. Hydraulic cylinders 28 and 30 are here shown adapted to the frame 10 and levers 24 and 26 as resistance means to provide surmountable resistance to movement of the levers 24 and 26. The apparatus of FIG. 1 also has reciprocating and resistance mechanisms 32 which are discussed in more detail hereinafter.

Tracks 16 and 18 are adapted to U-shaped frame member 10 and cross piece 12 in any conventional manner and preferably by use of appropriate bolts. The pedals 20 and 22 are slidingly adapted and move relative to tracks 16 and 18 in a relationship described more fully hereafter. The reciprocating and resistance mechanisms 32 cause pedals 20 and 22 to reciprocate relative to each other upon tracks 16 and 18. In other words, as pedal 20 is moved in one direction, for example, forward, pedal 22 moves in the other direction, for example, backward. The structures of the resistance and reciprocating mechanisms 32 are discussed more completely hereafter.

FIG. 1 shows levers 24 and 26 adapted to the frame member 10 by pivot pins or bolts 36 and 38. The levers 24 and 26 may thus be moved or pivoted relative to the frame 10 in general forward 21 and rearward 23 directions. The levers may also be adapted by ball and socket structure to allow for a wider range of movement.

The apparatus of FIG. 1 also includes resistance means which are hydraulic cylinders 28 and 30. They are adapted to the frame 10 at pivot pins 40 and 42. The hydraulic cylinders 28 and 30 are connected to the levers 24 and 26 by sliding yoke connections 44 and 46 to provide for widely adjustable or variable degrees of resistance as levers 24 and 26 are pivoted back and forth.

The cylinders 28 and 30 may be conventional cylinders suitable for use in exercise machines. Resistance to movement in the rearward direction 23 (toward support 14) is provided with little or no resistance to movement in the forward direction 21 toward cross piece 14 or toward the front or foot end 25 of the apparatus. It should be recognized that in some cases it may be preferred to provide resistance means in the form of hydraulic cylinders which provide resistance to movement in both the forward 21 and rearward 23 directions. Further, a resistance means may be provided which provides resistance the same as cylinders 28 and 30 but which also have springs associated therewith which provide additional resistance to rearward 23 movement and which urge the levers 24, 26 in the forward direction 21. Such may be particularly desirable for use in the configuration illustrated in FIG. 5.

In use, a user places his feet upon pedals 20 and 22 facing the direction of cross piece 12. Straps 50 and 52 are provided to snugly or tightly secure the front of the user's feet in the toe area to each pedal 20 and 22. Thus, the user may lift the heels of his feet in a manner comparable to a striding cross-country skier. The user stands erect on the pedals 20 and 22 and grasps with his hands handles 54 and 56 attached to levers 24 and 26. The levers 24 and 26 are sized in length 27 to extend to the waist area to approximate the height of cross-country ski poles. To perform cross-country skiing exercises, the user pushes back toward the rear 29 of the apparatus with his left foot upon pedal 22. The reciprocating and resistance mechanisms 32 at the same time cause pedal 20 and the user's right foot to move forward toward the foot end 25 of the apparatus. While the pedal 22 is being moved backward toward the rear 29, the user may also pull the lever 26 rearward 23 and move lever 24 forwardly 21. After pedal 22 is moved back a sufficient distance by the user to simulate a pushing action against snow by a cross-country skier, the user would then stop pushing back with his left foot and pulling up on handle 56 and then begin pushing with his right foot upon pedal 20 and pulling on handle 54, which would both then be in a forward position. As before, resistance and reciprocating mechanisms 32 cause pedal 22 to reciprocate or to move forward toward the foot end 25 as pedal 20 is moved toward the rear 29. If the user desires, as he pushes back upon one pedal he may also pull forward with the other leg upon the other pedal. As pedal 20 is moved backward, the user may pull back 23 upon lever 24 and push forward lever 26. Repetition of these movements may be regarded as approximating cross-country ski movements and a cross-country-skiing-type exercise. Of course, the user may use the levers 24 and 26 in any pattern which the user finds comfortable or useful.

FIG. 2 illustrates a multipurpose exerciser of FIG. 1 in a rowing exercise orientation and configuration. Second lever means are provided for performing rowing type exercises. The yoke connections 44 and 46 may be disconnected completely from the levers 24 and 26 and the levers moved to lay on the exercise surface toward the rear. Second lever means appropriately adopted to the frame 10 may then be connected to the cylinders 28 and 30 by yoke connections 44 and 46. However, such an arrangement is viewed as costly and not preferred. Rather, the levers 24 and 26 are each segmented into an elbow portion 37A and 39B and an extension portion 41A and 41B which are telescopingly assembled and secured by pins, by ball detent locks or other comparable fastening means.

In FIG. 2, the extension portions 41A and 41B of the levers 24 and 26 are removed from the elbow members 39A and 39B and replaced with rowing members 60 and 62 which telescope into elbow portions 37A and 37B to form the second lever means of the instant invention. Resistance and reciprocating mechanisms 32 have been disconnected from pedals 20 and 22 in a manner which will be described hereafter. The pedals 20, 22 are placed approximately side by side on the tracks 16 and 18. Seat means 64 is connected to the pedals 20, 22 by connection means which may be any acceptable nut and bolt or pin system to prevent the seat means 64 from slipping off of the pedals 20, 22. Preferably, the connection means is a hook member secured on the underside 66 of the seat means which coacts with a pile member secured atop 67 (FIG. 1) each pedal 20 and 22 so that seat member 64 is firmly attached by hook and pile connection to pedals 20 and 22. A velcro type hook and pile arrangement has been found to be quite suitable.

Figure 2A:
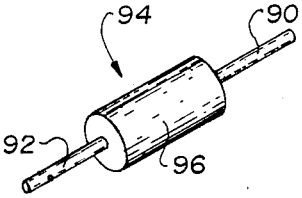
Figure 2C:
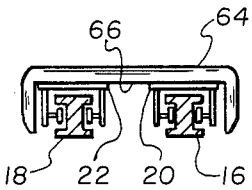

When reciprocating and resistance mechanisms 32 have been disconnected from pedals 20 and 22 and seat member 64 connected to pedals 20 and 22 as described and as shown in FIG. 2C, seat member 64 may freely slide back and forth attached to pedals 20 and 22 (which act as a kind of trolley) along the tracks 16 and 18. In this arrangement, legs 68 and 70 may be firmly but removably attached to support member 14 to change the angle 71 between rails 16 and 18 and the floor, to alter the difficulty of operation if desired by the user. The legs 68 and 70, here shown, may adjustably elevate the rear end 29 about 6 to about 10 inches from the exercise surface, thus angulating the main frame 10 a few degrees. As noted hereinbefore, the angle 71 can be varied by the use of legs of different lengths up to about 30 degrees until safe or practical exercises are no longer feasible. Removable pins 72 and 73 are used to detachably connect either extensions 41A and 41B or levers 60, 62 to elbow members 39A and 39B, as shown.

In use, the user places his feet on foot support means 74 and 76, which preferably have holding straps 78 and 80 to firmly hold the user's feet therein. The user sits upon seat member 64 and then grasps handles 82 and 84 with his hands.

To perform rowing type exercises, the user in one motion, pulls back upon handles 82 and 84 and at the same time pushes with his legs and feet against supports 74 and 76 to push the seat member 64 backwards towards the rear 29. The user then pulls his body forward with his legs, simultaneously moving seat member 64 forward upon rails 16 and 18. At the same time the user pushes handles 82 and 84 forward with his hands. Other rowing exercises may be performed as well as general exercises such as set-ups in this configuration.

An alternative exercise may be performed by placing the embodiment of FIG. 2 in an abdominal exercise configuration. Rowing handle members 60 and 62 are rotated from the orientation of FIG. 2 about 180° within elbows 38 and 39 so that sides 86 and 88 of handles 82 and 84 face inwardly and toward each other. Rods 90 and 92 of chest piece 94 are inserted into appropriately sized holes 86 and 88. Chest piece 94 has a soft padded cylindrical cushion 96.

To perform abdominal exercises, the user may sit upon seat 64 facing the rear 29 with his feet either upon the floor or positioned against support 14. Seat 64 may be slidable or may be made stationary by connecting reciprocating and resistance mechanisms 32 to pedals 20 and 22. Because pedals 20 and 22 must reciprocate and because seat 64 holds pedals 20 and 22 in place, seat 64 is then stationary. With chest piece 94 secured to handles 82 and 84 within holes 86 and 88 as previously described, the user may manipulate the handles 60 and 62 to position the chest piece 94 against the user's chest and thereafter bend forward toward support member 14, against the resistance of cylinders 28 and 30.

Still, further exercises may be performed by using second frame means with a user support means. The user support means is a cushion 100 which is adaptable to post 102, as shown in FIGS. 2B and 2D, which acts as a second frame means. The post 102 removably and slidingly engages with either C-shaped clip 104 or C-shaped clip 106. The cushion 100 may have a bracket 101 to preferably slidingly engage post 102, as shown in FIG. 2B. The cushion is thereby adjustably positionable along the length 103 of the post 102. Alternatively, the cushion 10D may be secured to post 102 by screws or bolts (not shown), as seen in FIG. 2D.

With the multipurpose exerciser in the rowing orientation, cushion 100 may be placed flat upon rails 16 and 18 with post 102 inserted into C-shaped member 106, with the top 108 of seat 100 facing away from the track 16, 18. In this configuration, the user may lie down with his back upon seat member 100 with his buttocks on seat 64 and grasping handles 82 and 84 to perform a press-type exercise against the resistance of the cylinders 28 and 30.

Other exercises may be performed by placing post 102 in C-shaped member 104, as illustrated in FIG. 2, and thereafter reorienting the multipurpose apparatus. That is, it may be tipped about 90° so that the bracket 101 or the underside 103 of post 102 of cushion 100 is placed upon the exercise surface, and so that rails 16 and 18 are upright and in this embodiment generally vertical (i.e., about plus or minus 20 degrees from the vertical). In this orientation, the user may lie on his back upon cushion 100 and do bench-press-type exercises by upward movement of handles 82 and 84. He may also kneel or stand upon cushion 100 facing toward or away from rails 16 and 18 and do other exercises such as a curling type exercise. A still further exercise may be performed by sitting upon cushion 100 facing away from rails 16 and 18 and pressing upward upon handles 82 and 84. Indeed, other exercises may be performed with the multipurpose exerciser in any of the disclosed orientations or configurations. For example, with the exerciser in a vertical orientation, just described, the chest piece 94 (FIG. 2A) could also be attached to handles 82 and 84 to do alternative or additional exercises.

The characteristics of the multipurpose exerciser of the invention may be altered additionally by attaching a pair of springs between pivot members 40, 44 and 42, 46. The spring would act in concert with the hydraulic cylinders 28, 30 to add additional resistance and to act to bias elbow members 38, 39 toward cross member 12.

FIGS. 3 and 4 illustrate two embodiments of the reciprocating and resistance mechanisms 32. Referring to FIG. 3, the reciprocating and resistance mechanisms 32 include sliding spool 114, bracket 116, spring 117, bracket 118, nut 119, sliding belt 120, stationary spool 122, pins 124 and 126, adjustment bolt 128, and L-shaped member 130.

Edges 134 and 136 of bracket 116 register with grooves 138 and 140 formed in the rails 16 and 18, so that bracket 116 slides in the grooves 138 and 140 relative to rails 16 and 18. Rails 16 and 18 connect to angle member 130 by means of screws 142 and 144 threading into registering holes in rails 16 and 18. Spool 114 is placed upon post 146 of bracket 116. Bracket 118 is then also placed on post 114. Spring 117 is placed on post 114 and nut 119 is securely threaded onto post 114.

Stationary spool 122 is firmly attached to cross member 12 by means of bolt 150 which is securely fastened to the spool 122 by a welded and threaded nut 152. Spools 114 and 122 may be assembled to rotate about their respective axis or made to not rotate. That is, the spools may be formed to have smooth metal, sliding surfaces 154 and 156, respectively. They may also be covered with a smooth and durable coating, such as Teflon TM.

Strap 120 is trained around spools 114 and 122. Sliding surfaces 154 and 156 of spools 114 and 122 provide friction resistance against movement of strap 120. Adjustment bolt 128 is placed in hole 160 and threaded into threads 162 of bracket 116. By turning adjustment bolt 128 clockwise, the bracket 116 may be slid toward member 14 to increase the tension on strap 120, and thereby to increase the friction resistance exerted on strap 120 by spools 114 and 122. Rotation of bolt 128 in a counterclockwise direction loosens the tension.

Preferably, nut 119 is tightened securely upon post 114 so that spool 114 will not rotate. Friction resistance on strap 120 is therefore solely adjusted by operating bolt 128. Alternatively, spool 114 is permitted to rotate on post 146. The frictional resistance between bracket 116, spool 114, and bracket 118 may thus be adjusted by rotating either or both of nut 119 and bolt 128.

Pedals 20 and 22 slidingly move relative to rails 16 and 18. Pedals 20 and 22 each have four concave wheels 164 which roll upon and register with convex edges 166, 168, 170, and 172 of rails 16 and 18, as generally shown in FIG. 3A. Flanges 174, 175, 176 and 177 preclude the concave wheels 164 from moving or rotating away from edges 166, 168, 170, and 174 and in turn retain the pedals 120 and 122 on rails 16 and 18. That is, rotational torque in the direction of arrow 179 causes the wheel to contact the flange 176 before dislodgment of the wheel 164 from the convex edge 166.

To connect the reciprocating and resistance mechanism to pedals 20 and 22, pins 124 and 126 are fastened to the strap 120 by any acceptable means, including screws or crimping, and placed within holes 180 and 182 of pedals 20 and 22. This connection causes pedals 20 and 22 to reciprocate relative to each other. In other words, as pedal 20 is moved toward support 14, pedal 22 must therefore move toward cross member 12. When pedal 22 is moved towards support 14, pedal 20 must move towards cross member 12. Resistance is provided by frictional engagement of strap 120 with spool 114 and 122, as previously described.

An alternative embodiment of reciprocating and resistance mechanisms 32 is illustrated in FIG. 4, and includes bracket 190, rotating spool 192, friction plate 194, spring 196, adjustment knob 198, cable 200, pulley 202, pins 204 and 206, and adjustment bolt 208.

Rails 16 and 18 are held in place on angle member 210 by bolts 212 and 214, which connect to rails 16 and 18. Bracket 190 slidingly positioned in the grooves 138, 148 of rails 16 and 18 in the same manner as bracket 116 in FIG. 3. Rotating spool 192 rotates upon carriage bolt 216. Friction plate 194, spring 196, and adjustment knob are placed upon spool 192 and carriage bolt 216. The adjustment knob 198 threads onto carriage bolt 216 to bias friction plate 194 against spool 192. Endless cable 200 has two stretches 218 and 220 which are trained around and connected to spool 192. Cable 200 also wraps around pulley 202 which is connected to cross piece 12 by means of carriage bolt 222 and nut 224 with bushing 226 and washer 228.

In use, pins 204 and 206 are connected to cable 200 and register with holes 180 and 182 of pedals 20 and 22, so as to cause pedals 20 and 22 to reciprocate upon rails 16 and 18 as described with regard to the description of the embodiment of FIG. 3. Plate 194 and face 230 of bracket 190 offer friction resistance to the rotation of spool 190. Adjustment knob 198 may be rotated clockwise or counterclockwise to increase or decrease the friction resistance offered, thereby providing an adjustment for the amount of resistance the resistance mechanism offers to the movement of pedals 20 and 22. Adjustment bolt 208 registers with hole 232 of angle member 210 and into threads 234 of bracket 190 so as to adjust the position of bracket 190 relative to rails 16 and 18. The adjustment of bolt 208 adjusts the tension on cable 200 so as to provide the proper tension for the reciprocating function of cable 200 and is not intended to directly affect the friction resistance.

Figure 5A:
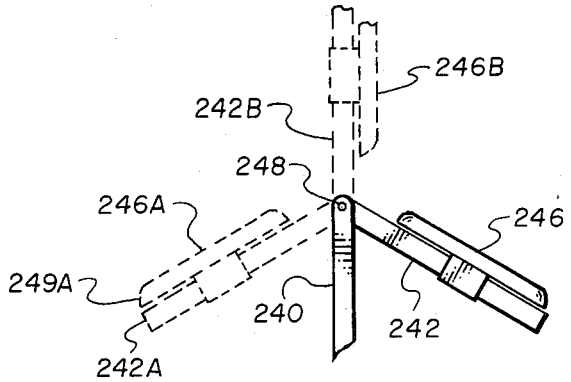
FIG. 5A is a partial side view of portions of the embodiment of FIG. 5.
Figure 5:
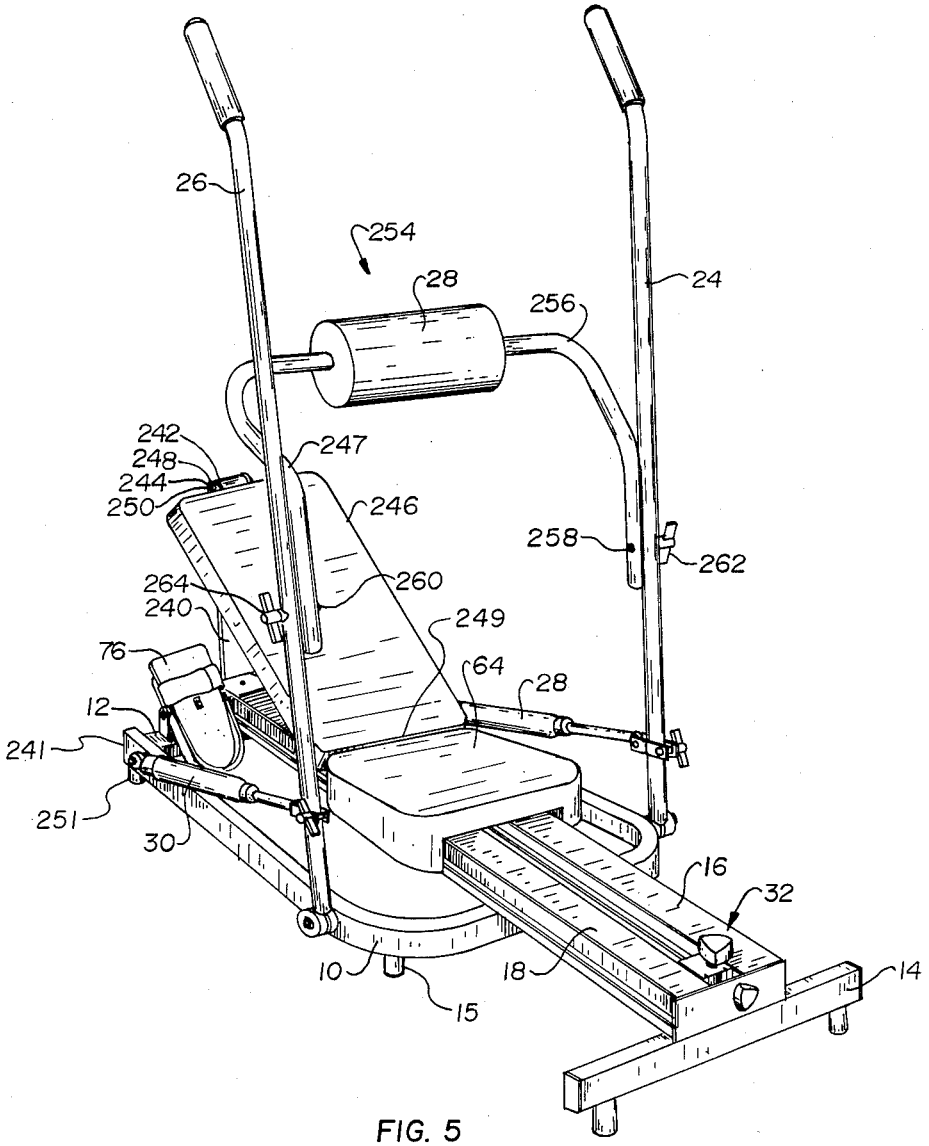
FIG. 5 is a perspective view of another embodiment of the invention in another configuration.

FIG. 5 illustrates another embodiment of the multipurpose exerciser of the invention. An upright post 240 is connected to cross piece 12. Legs 241 are of sufficient length such that when the apparatus, as illustrated in FIG. 5, is tipped or rotated about its foot and into an upright position so that upright post 240 is in a horizontal position, the legs 241 are then in substantially the same plane as the rear surface of upright post 240 so that a three-legged or tripod support is provided for the apparatus.

A slant bar 242 is hingingly attached by pin 244 to the free end 24B of upright post 240. Supported upon or by slant bar 242 is support or user pad 246. It is preferably sufficiently long and sufficiently wide to give reasonable support to the back or rear thoracic surface of a person performing exercises upon the apparatus. The slant bar 242 and support pad 246 may be rotated approximately from a first slanted or inclined position, illustrated in FIGS. 5 and 5A, to second position 242A shown in FIG. 5A through a third position 242B. The support pad 246, similar to that shown in FIG. 2B, may be slidably removed from bars 242 and rotated and placed again upon bar 242 in the position shown in phantom at 246B for use with the apparatus in the upright configuration and to the position shown in phantom at 246A for storage or for other exercises.

In FIG. 5, slant bar 242 and pad 246 are inclined so that the free end 244 of pad 246 rests upon rails 16 and 18. In the inclined position shown at 246A, pad 246 would rest with its free end 249A upon the floor or exercise surface.

It should be appreciated that the member 240 is shown in FIG. 5 to be essentially perpendicular to frame 10. That is, it is shown to be perpendicular within normal manufacturing tolerances. However, those skilled in the art know that the member 240 may be positioned off of the perpendicular to be generally upright, that is, it may be angled from the perpendicular as much as about 20°. Accordingly, the orientation of the frame 10 when it is tipped up to be supported by member 240, will be similarly affected but still generally upright.

FIG. 5 also illustrates another embodiment for a chest member. In FIG. 5, chest member 254 connects to cross-country lever members 24 and 26, instead of to levers 60 and 62 as described in reference to FIG. 2. Padded chest member 254 is mounted to a curved member 256, which in turn connects to levers 24 and 26 by means of bolts 258 and 260, respectively. Wing nuts 262 and 264 facilitate the convenient attachment or removal of chest member 254 from levers 124 and 126.

To use the apparatus illustrated in FIG. 5, the user may sit upon seat 64 and incline himself with his back upon padded member 246 and with his feet upon the floor or on member 14. The user may then grasp bar 256 with his hands to perform a pushing-type exercise or move the chest member 254 with his chest.

Reference herein to details of the illustrated embodiment is not intended to restrict the scope of the appended claims, which themselves recite those features regarded as essential to the invention.

I claim:

1. A multipurpose exercise apparatus usable in a plurality of configurations, said multipurpose exercise apparatus comprising:

main frame means having ends;

support means adapted to said main frame means for supporting said main frame means on an exercise surface;

track means adapted to said main frame means;

a pair of foot pedals spaced apart and adapted to said track means for movement along said track means by a user;

reciprocating means detachably connected to said pair of foot pedals for causing reciprocating movement of said pair of foot pedals relative to each other upon said track means;

a seat means, for supporting a user, said seat means being removably mounted on said pair of foot pedals, said seat means being held stationary by said foot pedals when said reciprocating means is connected, said seat means being slidable along said track means upon a detachment of said reciprocating means from said foot pedals, said foot pedals being reciprocably movable relative to each other upon said track means when said reciprocating means is connected and said seat means is removed;

first lever means having distal and proximal ends and movably mounted at its distal end to said main frame means for movement by a user, said first lever means being to extend from said main frame means a distance to be grasped and moved by the hands of a user standing on said pair of foot pedals, said first lever means also being graspable and movable by a user sitting on said seat means; and foot support means adapted to said main frame means for bracing the user's feet when the user is sitting on said seat means.

2. The multipurpose exercise apparatus of claim 1, wherein said track means is a pair of elongated spaced apart tracks adapted to said main frame means, and wherein one of said pair of foot pedals is adapted to one of spaced apart tracks and the other of said pair of foot pedals is adapted to the other of said spaced apart tracks.

3. The multipurpose exercise apparatus of claim 2 wherein both of said pair of foot pedals have a user support surface and wherein said seat means is connected to said foot pedals by a hook-and-pile-type connector having a pile structure secured to said user support surface and a hook structure secured to said seat means.

4. The multipurpose exercise apparatus of claim 2 wherein said pair of foot pedals each include a foot strap to hold the user's foot thereto, said foot strap being positioned thereon to secure the forward part of the foot and not restrict cross-country ski exercise stride movement.

5. The multipurpose exercise apparatus of claim 2, wherein each of said spaced apart tracks having opposite sides with guide structure formed therein, and wherein each of said pair of foot pedals have carriage structure configured to register with said guide structure.

6. The multipurpose exercise apparatus of claim 5, wherein said guide structure is a roller tracks with a convex member and wherein said carriage structure includes concave wheels sized to coact with said convex member.

7. The multipurpose exercise apparatus of claim 5, wherein said first resistance means is positioned proximate one end of said main frame means and proximate said track means, wherein said reciprocating means includes:

guide means positioned proximate the other end of said main frame means and proximate said track means;

endless loop means extending between said first resistance means and said guide means, said endless loop means having a first stretch and a second stretch, said endless loop being rotatable about both said guide means and said resistance means;

second connect means for connecting one of said pair of foot pedals to said first stretch and for connecting the other of said pair of foot pedals to said second stretch.

8. The multipurpose exerciser of claim 7, wherein said endless loop means is a cable, wherein said guide means is a rotatable spool, and wherein said resistance means includes a spool, a friction member mechanically associated with said spool for applying frictional resistance to the rotation of said spool, and means for varying the frictional resistance applied by said friction member against said spool.

9. The multipurpose exercise apparatus of claim 1, wherein said main frame means has opposite lateral sides and wherein said first lever means is a pair of levers each rotatably attached proximate their distal ends to said opposite lateral sides.

10. The multipurpose exercise apparatus of claim 7, wherein said second resistance means is a pair of fluid cylinders each having one end rotatably adapted to said main frame means and its other end adjustably connected to one of said pair of levers.

11. The multipurpose exercise apparatus of claim 8 further including chest bar means interconnectable between said pair of levers for movement by the chest of a user sitting on said seat means.

12. The multipurpose exercise apparatus of claim 1 further including second frame means removably adaptable to said main frame means at one end thereof to extend away therefrom, said second frame means being positioned and sized to support said main frame means in an upright orientation.

13. The multipurpose exercise apparatus of claim 12, wherein said second frame means comprises:

a first frame member removably adapted to said main frame means at one end thereof to extend away therefrom, said first frame member having a free end;

a second frame member rotatably mounted to said first frame member at its free end to rotate between a first position wherein said second frame member extends from said free end toward said track means and a second position wherein said second frame member extends away from said free end;

user support means removably adaptable to said first frame alternate member to support a user therein with said main frame means in said upright orientation and to said second frame member to support to a user as a slant board in said first position and to support a user in said third position.

14. The multipurpose exerciser of claim 13, wherein said main frame means has a foot end with said foot support means adapted proximate thereto, wherein said first frame member is an elongated bar mounted proximate said foot end of said main frame means, wherein said second frame member is an elongated bar, and wherein said user support means is slidably adaptable to said first or second frame members.

15. The multipurpose exercise apparatus of claim 1, wherein said second lever means is selectively connectable in place of said first lever means.

16. The multipurpose exercise apparatus of claim 1, wherein said first lever means is comprised of a first portion and a second portion adapted thereto and wherein said second lever means is selectively adapted to said first portion in replacement of said second portion.

17. A multipurpose exercise apparatus usable in a plurality of configurations, said multipurpose exercise apparatus comprising:

main frame means having ends;

support means adapted to said main frame means for supporting said main frame means on an exercise surface;

track means adapted to said main frame means;

a pair of foot pedals spaced apart and adapted to said track means for movement along said track means by a user;

reciprocating means detachably connected to said pair of foot pedals for causing reciprocating movement of said pair of foot pedals relative to each other upon said track means;

first resistance means mechanically associated with said reciprocating means for resisting the movement of said pair of foot pedals;

a seat means, for supporting a user, said seat means being removably mounted on said pair of foot pedals, in one configuration said seat means being held stationary by said connected reciprocating means in association with said foot pedals, in a second configuration said foot pedals being reciprocably moveable relative to each other upon said track means when said seat means is removed and said reciprocating means is connected;

first lever means having distal and proximal ends and movably mounted at its distal end to said main frame means for movement by a user, said first lever means being sized to extend from said main frame means a distance to be grasped and moved by the hands of a user standing on said pair of foot pedals, said first lever means also being graspable and movable by a user sitting on said seat means; and foot support means adapted to said main frame means for bracing the user's feet when the user is sitting on said seat means.

18. The multipurpose exercise apparatus of claim 17 wherein said reciprocating means includes:

a spool positioned proximate the one end of said main frame means and proximate said track means;

an endless cable extending between said first resistance means and said spool, said endless loop cable having a first stretch and a second stretch, said endless cable being rotatable about both said spool and said resistance means; and first connection means mounted on said cable for releasably connecting one of said pair of foot pedals to said first stretch and for releasably connecting the other of said pair of foot pedals to said second stretch, said first connection means including a pair of pins, each pin being removably inserted into a hole defined within a respective foot pedal.

19. The multipurpose exercise of claim 7, wherein said spool is rotatably mounted.

20. The multipurpose exercise apparatus of claim 18 wherein said resistance means includes a guide, said cable being trained about said guide, and tensioning means, mechanically associated with said guide, for displacing said guide along said main frame means, thereby adjusting a tension of said cable.

21. The multipurpose exercise apparatus of claim 20 wherein said guide is a spool.

22. The multipurpose exercise apparatus of claim 17 wherein said apparatus further includes said seat removably mounted to said foot pedals, in one configuration said seat being held stationary when said reciprocating means is connected and in a second configuration said seat being slidable along said track means upon a detachment of said reciprocating means from said foot pedals.

23. The multipurpose exercise apparatus of claim 1 wherein said apparatus further includes a first resistance means mechanically associated with said reciprocating means for resisting the movement of said pair of foot pedals.

24. The multipurpose exercise apparatus of claim 1 wherein said apparatus further includes second resistance means associated with said lever means to surmountably resist movement of said lever means.

25. The multipurpose exercise apparatus of claim 1 wherein said apparatus further includes second lever means for grasping and movement by the user sitting on said seat means.

26. A multipurpose exercise apparatus usable in a plurality of configurations, said multipurpose exercise apparatus comprising:

main frame means having ends;

support means adapted to said main frame means for supporting said main frame means on an exercise surface;

track means adapted to said main frame means;

a pair of foot pedals spaced apart and adapted to said track means for movement along said track means by a user;

reciprocating means detachably connected to said pair of foot pedals for causing reciprocating movement of said pair of foot pedals relative to each other upon said track means;

first resistance means mechanically associated with said reciprocating means for resisting the movement of said pair of foot pedals;

a seat means, for supporting a user, said seat means being removably mounted on said pair of foot pedals, in a first configuration said seat means being slidable along said track means when said reciprocating means is detached, in a second configuration said foot pedals being reciprocably movable relative to each other upon said track means when said seat means is removed and said reciprocating means is connected;

first lever means having distal and proximal ends and movably mounted at its distal end to said main frame means for movement by a user, said first lever means being sized to extend from said main frame means a distance to be grasped and moved by the hands of a user standing on said pair of foot pedals, said first lever means also being graspable and movable by a user sitting on said seat means; and foot support means adapted to said main frame means for bracing the user's feet when the user is sitting on said seat means.

27. The multipurpose exercise apparatus of claim 1 wherein said apparatus further includes a first resistance means mechanically associated with said reciprocating means for resisting the movement of said pair of foot pedals, a second resistance means associated with said lever means to surmountably resist movement of said lever means, and a second lever means for grasping and movement by the user sitting on said seat means.

* * * * *